US008205765B2

(12) United States Patent
Gruenwald et al.

(10) Patent No.: US 8,205,765 B2
(45) Date of Patent: Jun. 26, 2012

(54) GAS ABSORPTION RESERVOIR WITH OPTIMIZED COOLING

(75) Inventors: Werner Gruenwald, Gerlingen (DE); Thorsten Allgeier, Untergruppenbach (DE); Kai Oertel, Stuttgart (DE); Ian Faye, Stuttgart (DE); Stephan Leuthner, Leonberg (DE); Jan-Michael Graehn, Stuttgart (DE); Markus Schubert, Ludwigshafen (DE)

(73) Assignees: Robert Bosch GmbH, Stuttgart (DE); BASF Aktiengesellschaft, Ludwigshafen (DE)

( * ) Notice: Subject to any disclaimer, the term of this patent is extended or adjusted under 35 U.S.C. 154(b) by 664 days.

(21) Appl. No.: 12/299,560

(22) PCT Filed: Mar. 21, 2007

(86) PCT No.: PCT/EP2007/052674

§ 371 (c)(1),
(2), (4) Date: Jan. 26, 2009

(87) PCT Pub. No.: WO2007/128617

PCT Pub. Date: Nov. 15, 2007

(65) Prior Publication Data

US 2010/0006454 A1 Jan. 14, 2010

(51) Int. Cl.
*B65D 88/12* (2006.01)

(52) U.S. Cl. ..... 220/562; 206/0.7; 206/204; 137/1; 137/489; 137/511

(58) Field of Classification Search ..... 206/0.7; 220/562; 137/1, 489, 511
See application file for complete search history.

(56) References Cited

U.S. PATENT DOCUMENTS

| | | | | |
|---|---|---|---|---|
| 5,916,245 | A * | 6/1999 | Tom | 62/46.1 |
| 6,182,717 | B1 | 2/2001 | Yamashita | |
| 6,591,616 | B2 | 7/2003 | Ovshinsky et al. | |
| 2001/0025670 | A1 | 10/2001 | Ovshinsky et al. | |
| 2002/0029820 | A1 | 3/2002 | Ovshinsky et al. | |
| 2002/0029821 | A1 | 3/2002 | Ovshinsky et al. | |
| 2002/0100369 | A1 | 8/2002 | Kuriiwa et al. | |
| 2005/0211573 | A1 | 9/2005 | Myasnikov et al. | |
| 2005/0287407 | A1 | 12/2005 | Bushko | |

FOREIGN PATENT DOCUMENTS

| | | | |
|---|---|---|---|
| EP | 0995944 | A2 | 4/2000 |
| FR | 2580376 | A1 | 10/1986 |
| WO | 0113032 | A1 | 2/2001 |

* cited by examiner

*Primary Examiner* — Anthony Stashick
*Assistant Examiner* — Elizabeth Volz
(74) *Attorney, Agent, or Firm* — Ronald E. Greigg

(57) ABSTRACT

The invention relates to a fuel reservoir for gaseous fuel in a vehicle, in particular a sorption reservoir. The fuel reservoir is delimited by at least one wall and includes a sorption material that is contained in its interior. The fuel reservoir has a tank inlet valve containing a shut-off valve and a throttle restriction valve. The restriction of the gaseous fuel takes place inside the fuel reservoir.

8 Claims, 2 Drawing Sheets

GAS ABSORPTION RESERVOIR WITH OPTIMIZED COOLING

CROSS-REFERENCE TO RELATED APPLICATION

This application is a 35 USC 371 application of PCT/EP 2007/052674 filed on Mar. 21, 2007.

BACKGROUND OF THE INVENTION

1. Field of the Invention

The invention relates to a fuel reservoir for gaseous fuel in a vehicle, in particular a sorption reservoir.

2. Description of the Prior Art

As an alternative to liquid fuels, gaseous fuels can be used, which differ from fuels that are in liquid form in having a lower energy density. Because of their lower energy density, gaseous fuels in motor vehicles or in buses or utility vehicles for local or long-distance travel are stored in pressure reservoirs. Inside such a pressure reservoir, the pressure level is on the order of magnitude of about 200 bar. The tanks of compressed-gas-powered vehicles are filled at filling stations that have gas pumps equipped especially for filling the tanks of compressed-gas-powered vehicles, which make the gaseous fuel available at a pressure of more than 200 bar. Such gas pumps require an upstream compressor in order to offer this pressure, which involves a considerable expenditure of energy in order to maintain the pressure level of about 10 bar.

From U.S. Pat. No. 6,591,616 B2, an infrastructure for storing hydrogen for a hydrogen-fueled vehicle is known. Hydrogen is carried into a vehicle tank by means of a compressor that at the same time serves as a storage unit. The hydrogen, which is at high pressure, is introduced via a metering valve by means of a hydrogen supply line. Inside the hydrogen tank of the vehicle, the hydrogen is absorbed by an adsorption material, which gives off heat. This heat, in the version in U.S. Pat. No. 6,591,616 B2, is dissipated by water cooling. The heat is transported back to the metering valve via a cooling line. The cooling medium is then earned onward from the metering valve to the compressor of the filling station or to the hydrogen reservoir. The cooling medium gives off its heat inside the compressor. With the version known from U.S. Pat. No. 6,591,616 B2, rapid filling of the tank of a hydrogen-fueled vehicle is made possible at relatively high pressures, and by way of the water cooling, impermissibly high heating up of the hydrogen tank of the vehicle is avoided.

From European Patent Disclosure EP 0 995 944 A2, a method for filling a vehicle tank with hydrogen is known. The hydrogen tank of the vehicle includes a metal hydride, at which the hydrogen is absorbed. The heat that occurs in the hydrogen tank is used to heat a metal hydride material in the supply tank of a cooling station. As the heat transfer medium, water is used, which circulates between the tank of the filling station and the hydrogen tank of the vehicle. The metal hydride, which is provided in the hydrogen vehicle tank and is heated by the absorption of hydrogen, is cooled by means of the water, and the water, which is heated in this way, is pumped to the hydrogen tank of the filling station. Inside the hydrogen tank in the filling station, the metal hydride located there is heated again by the heated water, so that hydrogen is given off, and the water functioning as a circulation medium assumes a lower temperature.

In order to assure a maximum range for a motor vehicle with an acceptable size of tank, for a gaseous fuel in that vehicle, sorption reservoirs based on metal hydrides (chemical adsorption), activated charcoal, zeolites or metal organic frameworks (MOFs) in the context of physical adsorption are used. As explained above, when the tank is filled with a gaseous fuel, its binding energy (desorption) is released as heat and is dissipated. The storage capacity of a tank for gaseous fuel decreases with increasing temperature. Gas cools off upon adiabatic expansion. Depending on the isentropene exponent, the cooling effect is enhanced still further, as for example with a gaseous fuel such as methane, $CH_4$. The work produced upon adiabatic expansion amounts to the following (according to R. W. Pohl: *Mechanik, Akustik, Wärmelehre* [Mechanics, Acoustics, Thermodynamics], Springer 1959, p. 258):

$$W_{mol} = \frac{R \cdot T}{\kappa - 1} \cdot \left[1 - \left(\frac{p_2}{p_1}\right)^{\frac{\kappa-1}{\kappa}}\right] \qquad \text{Equation 1}$$

W=work

R=gas constant

T=temperature

κ=isentropene exponent $p_1$=pressure upstream of the throttle restriction (filling station)

$p_2$=pressure downstream of the throttle restriction (tank: $p_2 \rightarrow p_2'$)

In the process of filling the tank, the tank pressure $p_2$ rises from the initial pressure with an empty tank to the final pressure. This means that as the tank pressure rises during the filling, the usable cooling energy drops, as a function of the current tank pressure.

FIG. 1 shows the course of the decrease in the cooling energy from adiabatic expansion at a filling pressure $p_1$ of 200 bar, plotted over the reservoir pressure p in bar. With increasing pressure in the tank, or in other words with a descending pressure gradient, this effect lessens.

In the ideal case, the cooling energy should at least partially compensate for the heat of adsorption A liberated, so that the temperature in the tank for a gaseous fuel remains as constant as possible. The change in temperature is determined by the adsorbed gas quantity n. The temperature that a tank assumes on receiving a gaseous fuel is defined by $$\Delta T = \frac{n \cdot \Delta E}{C_{Sp} \cdot M_{Sp}} = \frac{n \cdot A}{C_{Sp} \cdot M_{Sp}} \qquad \text{Equation 2}$$

n=fuel quantity of the gas put in the tank $C_{Sp}$=specific heat of the reservoir material A: sorption enthalpy $M_{Sp}$=mass of the reservoir The change in temperature in the tank during tank filling will now be estimated using $CH_4$. If 30 kg of $CH_4$, corresponding to 1875 mol of $CH_4$, are put in the tank, this is equivalent to a liberated heat of adsorption A of 12.5 kJ/mol. The mass of the reservoir is estimated at 200 kg; the specific heat of the reservoir material $C_{Sp}$ is 1.3 kJ/kg/K. The temperature rises to approximately 90° C., beginning at an outset temperature of 25° C.

Since in previous introduced conceptions of tank systems for compressed-gas-powered vehicles, there is a high potential for danger in terms of the compressor complexity and the high pressures to be controlled, this is an overall unsatisfactory situation, since the operation of compressed-gas-powered vehicles offers several advantages, particularly with regard to pollutant emissions. The gaseous fuel forms an especially good mixture with air, and with regard to pollutant emissions, gaseous fuel is distinguished by markedly lower amounts of polycyclic aromatic hydrocarbons, compared with gasoline-powered internal combustion engines. Gaseous fuel is maximally free of lead compounds and sulfur compounds and has very good combustion properties with excellent mixture formation and mixture distribution, which is even more pronounced especially at low temperatures.

OBJECT AND SUMMARY OF THE INVENTION

In view of the gas tanks operated at relatively high pressures that are known from the prior art and the technical problems discussed, it is the object of the invention to make a reservoir for gaseous fuel available that on the one hand can be operated at a lower pressure level, compared with currently used compressed gas reservoirs, and in which the heat of adsorption by means of sorption is at least partly compensated for.

According to the invention, this object is attained in that the physical effect of cooling from adiabatic expansion with the physical effect of heating of the tank from sorption, such as physical adsorption in the case of metal organic framework, MOF, is compensated for by the installed position of a throttle valve on the filling side of the tank for gaseous fuel. By the use of MOF in a tank for receiving gaseous fuel, the pressure level when the tank is being filled can moreover advantageously be lowered to a considerably lower pressure level. This pressure level is below 100 bar; it is preferably <80 bar and especially preferably <50 bar, but is above 10 bar. Natural gas or city gas is preferably used as the gaseous fuel.

Preferably, the tank inlet valve disposed on the filling side of the tank for gaseous fuel is designed as a unit comprising a check valve with only slight throttling action and a throttle valve with great throttling action and a large opening cross section or throttle cross section.

With the version proposed according to the invention, the throttling is effected in the tank for the gaseous fuel, and thus the desired further cooling ensues inside the tank. In a first variant embodiment, the gaseous fuel held in reserve and stored at low temperature at the filling station flows through the tank. The tank is cooled down to such an extent that the ensuing heating from sorption of the gaseous fuel is compensated for at an accumulation structure, preferably in the form of MOF. At a second tank opening or through a tank provided with a double wall, the gas flows back to the filling station. This is similar to the aspiration of vapors in liquid fuels in pump nozzles in current use, with the distinction that the gas has flowed through the tank and possibly the double wall of the tank before it is extracted by suction by the filling station.

The tank inlet valve, including a check valve and a throttle valve, can be manufactured with regard to the throttle valve as a perforated plate, frit, or tom, or as porous metal foam. If a frit is used, then it can comprise either glass or porous ceramic. In the tank for gaseous fuel, a spatially distributed throttling can be accomplished at a plurality of throttle restrictions that are disposed centrally in the tank, or a throttle element with major throttling action and a large opening cross section or throttle cross section can be disposed on the filling side of the tank directly downstream of the check valve of the tank inlet valve.

BRIEF DESCRIPTION OF THE DRAWINGS

The invention will be described in further detail below in conjunction with the drawings, in which.

DESCRIPTION OF THE PREFERRED EMBODIMENTS

Figure 1:
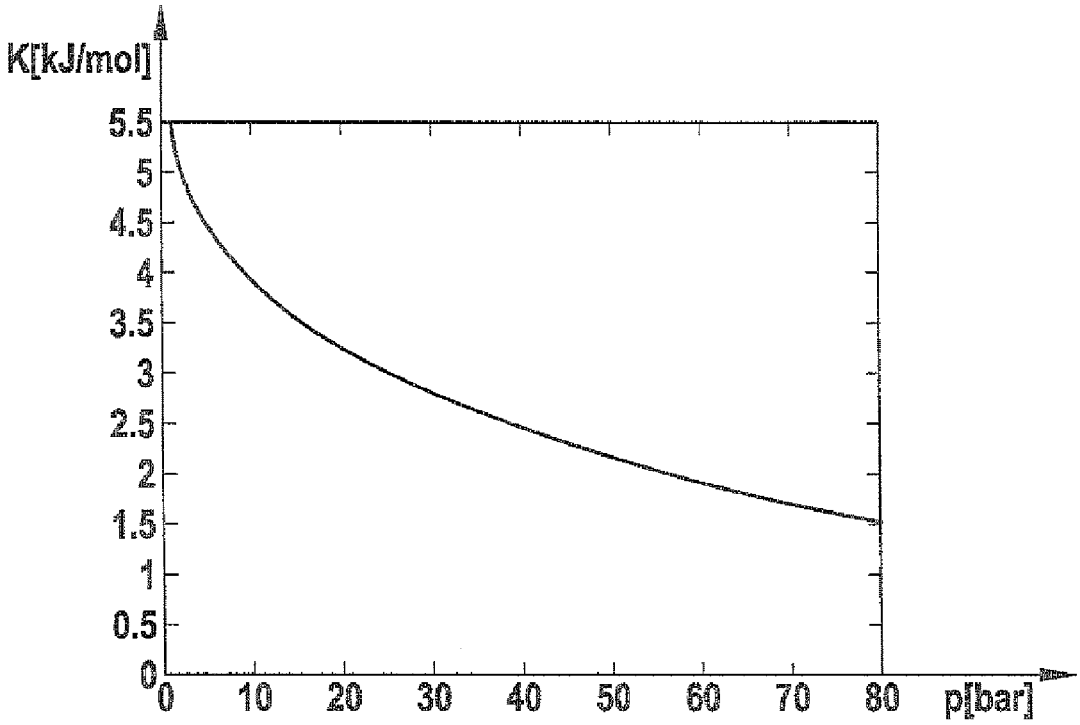
FIG. 1 shows the course of the cooling energy in kJ/mol, plotted over the reservoir pressure p in bar for a primary ingredient of natural gas $CH_4$, in which $\kappa=1.33$, T=25° C., and the filling pressure $p_1$ is 200 bar.

From the diagram in FIG. 1, the course of the cooling energy for $CH_4$ can be seen, where $\kappa=1.33$, a filling pressure $p_1$ is 200 bar, and a temperature of T=25° C.

It can be seen from FIG. 1 that the utilizable cooling energy K, for a virtually completely empty tank, assumes its maximum value for receiving a gaseous fuel, such as $CH_4$. During the tank filling process, the cooling energy K, as shown by the course of the curve in FIG. 1, decreases steadily with increasing filling of the tank for gaseous fuel, such as $CH_4$, and at a reservoir pressure p of 50 bar, for instance, it assumes a value of approximately 2.25 kJ/mol. The course shown in FIG. 1 of the cooling energy K from adiabatic expansion, at an outset pressure of $p_1$, is utilized by the version proposed according to the invention compensation of the in the accumulation of gaseous fuel on an accumulation structure, preferably embodied as an MOF structure, contained in the tank for gaseous fuel.

The term tank will be understood hereinafter to mean a container which is used preferably in motor vehicles or utility vehicles and which stores the gaseous fuel for an internal combustion engine. The volume of this tank is in a range from 50 to 400 L, for example, for passenger cars, and more than 500 L for utility vehicle applications. The tank is at a system pressure of <100 bar, preferably <80 bar, and especially preferably ≦50 bar, but in any event above 10 bar, and is provided In its interior with the aforementioned accumulation structure for the gaseous fuel. The term accumulation structure for the gaseous fuel will be understood hereinafter to mean a structure with which gaseous fuel is stored in the tank and which is preferably used, in the form of Cu MOF or Al MOF, that is, a copper or aluminum metal organic framework (MOF), for physical adsorption.

The porous metal structural material contains at least one at least bidentate organic compound, with a semipolar bond to at least one metal ion. This metal organic structural material (MOF) is described for instance in U.S. Pat. No. 5,648,508; European Patent Disclosure EP-A 0 790 253; M. O'Keeffe et al, J. Sol. State Chem., 152 (2000), pp. 3-20; H. Li et al, Nature 402 (1999), p. 276; M. Eddaoudi et al, Topics in Catalysis 9 (1999), pps. 105-111; B. Chen et al, Science 291 (2001), pp. 1021-1023; and German Patent Disclosure DE-A 101 11 230.

The MOFs according to the present invention contain pores, in particular micropores and/or mesopores. Micropores are defined as pores with a diameter of 2 nm or less, and mesopores are defined by a diameter in the range from 2 to 50 nm, each in accordance with the definition as given in Pure Applied Chem. 45, p. 71, and in particular p. 79 (1976). Checking for the presence of micropores and/or mesopores can be done by means of sorption measurements, and these measurements determine the holding capacity of the metal organic structural materials for nitrogen at 77 Kelvin in accordance with DIN 66131 and/or DIN 66134.

Preferably, the specific surface area—calculated by the Langmuir model (DIN 66131, 66134) for an MOF in powder form amounts to more than 5 $m^2/g$, more preferably over 10 $m^2/g$, still more preferably more than 50 $m^2/g$, even more preferably more than 500 $m^2/g$, even more preferably more than 1000 $m^2/g$, and especially preferably more than 1500 $m^2/g$.

MOF shaped bodies can have a lower specific surface area, but preferably it is more than 10 $m^2/g$, still more preferably more than 50 $m^2/g$, even more preferably more than 500 $m^2/g$, and in particular more than 1000 $m^2/g$.

The metal component in the structural material according to the present invention is preferably selected from the groups comprising Ia, IIa, IIIa, IVa through VIIIa and Ib through VIb. Those that are especially preferred are Mg, Ca, Sr, Ba, Sc, Y, Ti, Zr, Hf, V, Nb, Ta, Cr, Mo, W, Mn, Re, Fe, Ru, Os, Co, Rh, Ir, Ni, Pd, Pt, Cu, Ag, Au, Zn, Cd, Hg, Al, Ga, In, Tl, Si, Ge, Sn, Pb, As, Sb and Bi. Those that are even more preferable are Zn, Cu, Mg, Al, Ga, In, Sc, Y, Lu, Ti, Zr, V, Fe, Ni, and Co. Among these, Cu, Zn, Al, Fe and Co are especially preferred. Ions of these elements that can be mentioned in particular are $Mg^{2+}$, $Ca^{2+}$, $Sr^{2+}$, $Ba^{2+}$, $Sc^{3+}$, $Y^{3+}$, $Ti^{4+}$, $Zr^{4+}$, $Hf^{4+}$, $V^{4+}$, $V^{3+}$, $V^{2+}$, $Nb^{3+}$, $Ta^{3+}$, $Cr^{3+}$, $Mo^{3+}$, $W^{3+}$, $Mn^{3+}$, $Mn^{2+}$, $Re^{3+}$, $Re^{2+}$, $Fe^{3+}$, $Fe^{2+}$, $Ru^{3+}$, $Ru^{2+}$, $Os^{3+}$, $Os^{2+}$, $Co^{3+}$, $Co^{2+}$, $Rh^{2+}$, $Rh^{+}$, $Ir^{2+}$, $Ir^{+}$, $Ni^{2+}$, $Ni^{+}$, $Pd^{2+}$, $Pd^{+}$, $Pt^{2+}$, $Pt^{+}$, $Cu^{2+}$, $Cu^{+}$, $Ag^{+}$, $Au^{+}$, $Zn^{2+}$, $Cd^{2+}$, $Hg^{2+}$, $Al^{3+}$, $Ga^{3+}$, $In^{3+}$, $Tl^{3+}$, $Si^{4+}$, $Si^{2+}$, $Ge^{4+}$, $Ge^{2+}$, $Sn^{4+}$, $Sn^{2+}$, $Pb^{4+}$, $Pb^{2+}$, $As^{5+}$, $As^{3+}$, $As^{+}$, $Sb^{5+}$, $Sb^{3+}$, $Sb^{+}$, $Bi^{5+}$, $Bi^{3+}$ and $Bi^{+}$.

The term "at least bidentate organic compound" means an organic compound which contains at least one functional group that is capable, for a given metal ion, to embody at least two and preferably two semipolar bonds, and/or for two or more, preferably two metal atoms, to embody one semipolar bond each.

In particular, the following functional groups can be named as functional groups by way of which the aforementioned semipolar bonds can be embodied: $—CO_2H$, $—CS_2H$, $—NO_2$, $—B(OH)_2$, $—SO_3H$, $—Si(OH)_3$, $—Ge(OH)_3$, $—Sn(OH)_3$, $—Si(SH)_4$, $—Ge(SH)_4$, $—Sn(SH)_3$, $—PO_3H$, $—AsO_3H$, $—AsO_4H$, $—P(SH)_3$, $—As(SH)_3$, $—CH(RSH)_2$, $—C(RSH)_3$, $—CH(RNH_2)_2$, $—C(RNH_2)_3$, $—CH(ROH)_2$, $—C(ROH)_3$, $—CH(RCN)_2$, and $—C(RCN)_3$, in which R for instance preferably stands for an alkylene group having 1, 2, 3, 4, or 5 carbon atoms, such as a methylene, ethylene, n-propylene, i-propylene, n-butylene, i-butylene, tert-butylene, or n-pentylene group, or an aryl group containing 1 or 2 aromatic nuclei such as 2 $C_6$ rings, which can optionally be condensed and can each be substituted for, independently of one another, by at least one substituent, and/or which independently of one another can each contain at least one heterocyclic atom, such as N, O, and/or S. As embodiments that are likewise preferred, functional groups can be named in which the aforementioned radical R is not present. In this respect, among others, $—CH(SH)_2$, $—C(SH)_3$, $—CH(NH_2)_2$, $—C(NH_2)_3$, $—CH(OH)_2$, $—C(OH)_3$, $—CH(CN)_2$, or $—C(CN)_3$ can be named.

The at least two functional groups an fundamentally be bonded to any suitable organic compound, as long it is assured that the organic compound having these functional groups is capable of forming the semipolar bond and of producing the structural material.

Preferably, the organic compounds which contain the at least two functional groups are derived from a saturated or unsaturated aliphatic compound or an aromatic compound or a compound that is both aliphatic and aromatic.

The aliphatic compound or the aliphatic portion of the compound that is both aliphatic and aromatic can be linear and/or branched and/or cyclic, and a plurality of cycles per compound are also possible. Also preferably, the aliphatic compound or the aliphatic part of the compound that is both aliphatic and aromatic contains from 1 to 15, more preferably 1 to 14, more preferably 1 to 13, more preferably 1 to 12, more preferably 1 to 11, and especially preferably 1 to 10 C atoms, for instance, 1, 2, 3, 4, 5, 6, 7, 8, 9 or 10 C atoms. Among others, methane, adamantane, acetylene, ethylene, or butadiene is especially preferred.

The aromatic compound or the aromatic part of the compound that is both aromatic and aliphatic can have one or more nuclei, such as two, three, four or five nuclei, and the nuclei can be present separately from one another, and/or at least two nuclei can be present in condensed form. Especially preferably, the aromatic compound or the aromatic part of the compound that is both aliphatic and aromatic has one, two, or three nuclei, and one or two nuclei are especially preferred. Independently of one another, each nucleus of the aforementioned compound can furthermore contain at least one heterocyclic atom, such as N, O, S, B, P, Si, Al, and preferably N, O, and/or S. More preferably, the aromatic compound or the aromatic part of the compound that is both aromatic and aliphatic contains one or two $C_6$ nuclei, and the two are either separate from one another or are present in condensed form. As the aromatic compounds, benzene, naphthalene and/or biphenyl and/or bipyridyl and/or pyridyl can be named in particular.

Preferably, the at least bidentate organic compound is derived from a di-, tri- or tetracarboxylic acid or its sulfur analogs. The functional groups —C(=O)SH along with its tautomers and —C(=S)SH are sulfur analogs, which can be used instead of one or more carboxylic acid groups.

The term "derive" in the context of the present invention means that the at least bidentate organic compound can be present in the structural material in partially deprotonized or fully deprotonized form. Moreover, the at least bidentate organic compound can contain still other substituents, such as —OH, $—NH_2$, $—OCH_3$, $—CH_3$, $—NH(CH_3)$, $—N(CH_3)_2$, —CN, and halides.

For instance within the context of the present invention, the following can be named: dicarboxylic acids such as oxalic acid, succinic acid, tartaric acid, 1,4-butanedicarboxylic acid, 4-oxopyran-2,6-dicarboxylic acid, 1,6-hexanedicarboxylic acid, decanedicarboxylic acid, 1,8-heptadecanedicarboxylic acid, 1,9-heptadecanedicarboxylic acid, heptadecanedicarboxylic acid, acetylenedicarboxylic acid, 1,2-benzenedicarboxylic acid, 2,3-pyridinedicarboxylic acid, pyridine-2,3-dicarboxylic acid, 1,3-butadiene-1,4-dicarboxylic acid, 1,4-benzenedicarboxylic acid, p-benzenedicarboxylic acid, imidazole-2,4-dicarboxylic acid, 2-methylquinoline-3,4-dicarboxylic acid, quinoline-2,4-dicarboxylic acid, quinoxaline-2,3-dicarboxylic acid, 6-chloroquinoxaline-2,3-dicarboxylic acid, 4,4'-diaminephenylmethane-3,3'-dicarboxylic acid, quinoline-3,4-dicarboxylic acid, 7-chloro-4-hydroxyquinoline-2,8-dicarboxylic acid, diimiddicarboxylic acid, pyridine-2,6-dicarboxylic acid, 2-methylimidazole-4,5-dicarboxylic acid, thiophene-3,4-dicarboxylic acid, 2-isopropylimidazole-4,5-dicarboxylic acid, tetrahydropyran-4,4-dicarboxylic acid, perylene-3,9-dicarboxylic acid, perylenedicarboxylic acid, pluriol E 200-dicarboxylic acid, 3,6-dioxaoctanedicarboxylic acid, 3,5-cyclohexadiene-1,2-dicarboxylic acid, octadicarboxylic acid, pentane-3,3-carboxylic acid, 4,4'-diamino-1,1'-diphenyl-3,3'-dicarboxylic acid, 4,4'-diaminodiphenyl-3,3'-dicarboxylic acid, benzidine-3,3'-dicarboxylic acid, 1,4-bis-(phenylamino)benzene-2,5-dicarboxylic acid, 1,1'-dinapthyl-5,5'-dicarboxylic acid, 7-chloro-8-methylquinoline-2,3-dicarboxylic acid, 1-anilinoanthraquinone-2,4'-dicarboxylic acid, polytetrahydrofuran-250-dicarboxylic acid, 1,4-bis-(carboxymethyl)piperazine-2,3-dicarboxylic acid, 7-chloroquinoline-3,8-dicarboxylic acid, 1-(4-carboxy)phenyl-3-(4-chloro) phenylpyrazoline-4,5-dicarboxylic acid, 1,4,5,6,7,7-hexachloro-5-norbornene-2,3-dicarboxylic acid, phenylindanedicarboxylic acid, 1,3-dibenzyl-2-oxoimidazolidine-4,5-dicarboxylic acid, 1,4-cyclohexanedicarboxylic acid, naphthalene-1,8-dicarboxylic acid, 2-benzoylbenzene-1,3-dicarboxylic acid, 1,3-dibenzyl-2-oxoimidazolidine-4,5-cis-dicarboxylic acid, 2,2'-biquinoline-4,4'-dicarboxylic acid, pyridine-3,4-dicarboxylic acid, 3,6,9-trioxaundecanedicarboxylic acid, O-hydroxybenzophenonedicarboxylic acid, pluriol E 300-dicarboxylic acid, pluriol E 400-dicarboxylic acid, pluriol E 600-dicarboxylic acid, pyrazole-3,4-dicarboxylic acid, 2,3-pyrazinedicarboxylic acid, 5,6-dimethyl-2,3-pyrazinedicarboxylic acid, 4,4'-diaminodiphenyletherdiimiddicarboxylic acid, 4,4'-diaminodiphenylmethanediimiddicarboxylic acid, 4,4'-diaminodiphenyl sulfonediimiddicarboxylic acid, 2,6-naphthalenedicarboxylic acid, 1,3-adamantanedicarboxylic acid, 1,8-naphthalenedicarboxylic acid, 2,3-naphthalenedicarboxylic acid, 8-methoxy-2,3-naphthalenedicarboxylic acid, 8-nitro-2,3-naphthalenedicarboxylic acid, 8-sulfo-2,3-naphthalenedicarboxylic acid, anthracene-2,3-dicarboxylic acid, 2',3'-diphenyl-p-terphenyl-4,4"-dicarboxylic acid, diphenylether-4,4'-dicarboxylic acid, imidazole-4,5-dicarboxylic acid, 4(1H)-oxothiochromene-2,8-dicarboxylic acid, 5-tert-butyl-1,3-benzenedicarboxylic acid, 7,8-quinolinedicarboxylic acid, 4,5-imidazoledicarboxylic acid, 4-cyclohexene-1,2-dicarboxylic acid, hexatriacontanedicarboxylic acid, tetradecanedicarboxylic acid, 1,7-heptadicarboxylic acid, 5-hydroxy-1,3-benzenedicarboxylic acid, pyrazine-2,3-dicarboxylic acid, furan-2,5-dicarboxylic acid, 1-nonene-6,9-dicarboxylic acid, icosenedicarboxylic acid, 4,4'-dihydroxydiphenylmethane-3,3'-dicarboxylic acid, 1-amino-4-methyl-9,10-dioxo-9,10-dihydroanthracene-2,3-dicarboxylic acid, 2,5-pyridinedicarboxylic acid, cyclohexene-2,3-dicarboxylic acid, 2,9-dichlorofluororubin-4,11-dicarboxylic acid, 7-chloro-3-methylquinoline-6,8-dicarboxylic acid, 2,4-dichlorobenzophenone-2',5'-dicarboxylic acid, 1,3-benzenedicarboxylic acid, 2,6-pyridinedicarboxylic acid, 1-methylpyrrole-3,4-dicarboxylic acid, 1-benzyl-1H-pyrrole-3,4-dicarboxylic acid, anthraquinone-1,5-dicarboxylic acid, 3,5-pyrazoledicarboxylic acid, 2-nitrobenzene-1,4-dicarboxylic acid, heptane-1,7-dicarboxylic acid, cyclobutane-1,1-dicarboxylic acid, 1,14-tetradecanedicarboxylic acid, 5,6-dehydronorbornane-2,3-dicarboxylic acid, or 5-ethyl-2,3-pyridinedicarboxylic acid;

tricarboxylic acids, such as 2-hydroxy-1,2,3-propanetricarboxylic acid, 7-chloro-2,3,8-quinolinetricarboxylic acid, 1,2,4-benzenetricarboxylic acid, 1,2,4-butanetricarboxylic acid, 2-phosphono-1,2,4-butanetricarboxylic acid, 1,3,5-benzenetricarboxylic acid, 1-hydroxy-1,2,3-propanetricarboxylic acid, 4,5-dihydro-4,5-dioxo-1H-pyrrolo[2,3-F]quinoline-2,7,9-tricarboxylic acid, 5-acetyl-3-amino-6-methylbenzene-1,2,4-tricarboxylic acid, 3-amino-5-benzoyl-6-methylbenzoyl-1,2,4-tricarboxylic acid, 1,2,3-propanetricarboxylic acid, or aurinetricarboxylic acid;

or tetracarboxylic acids, such as 1,1-dioxideperylo[1,12-BCD]thiophene-3,4,9,10-tetracarboxylic acid, perylenetetracarboxylic acids such as perylene-3,4,9,10-tetracarboxylic acid or perylene-1,12-sulfone-3,4,9,10-tetracarboxylic acid, butanetetracarboxylic acids such as 1,2,3,4-butanetetracarboxylic acid or meso-1,2,3,4-butanetetracarboxylic acid, decane-2,4,6,8-tetracarboxylic acid, 1,4,7,10,13,16-hexaoxacyclooctadecane-2,3,11,12-tetracarboxylic acid, 1,2,4,5-benzenetetracarboxylic acid, 1,2,11,12-dodecanetetracarboxylic acid, 1,2,5,6-hexanetetracarboxylic acid, 1,2,7,8-octanetetracarboxylic acid, 1,4,5,8-naphthalenetetracarboxylic acid, 1,2,9,10-decanetetracarboxylic acid, benzophenonetetracarboxylic acid, 3,3',4,4'-benzophenonetetracarboxylic acid, tetrahydrofurantetracarboxylic acid, or cyclopentanetetracarboxylic acids such as cyclopentane-1,2,3,4-tetracarboxylic acid.

Quite particularly preferably, optionally at least singly substituted mono-, di-, tri-, tetra or higher-nucleic aromatic di-, tri-, or tetracarboxylic acids are used, and each of the nuclei can contain at least one heterocyclic atom, and two or more nuclei can contain either the same or different heterocyclic atoms. For Instance, mononucleic dicarboxylic acids, mononucleic tricarboxylic acids, mononucleic tetracarboxylic acids, dinucleic dicarboxylic acids, dinucleic tricarboxylic acids, dinucleic tetracarboxylic acids, trinucleic dicarboxylic acids, trinucleic tricarboxylic acids, trinucleic tetracarboxylic acids, tetranucleic dicarboxylic acids, tetranucleic tricarboxylic acids, and/or tetranucleic tetracarboxylic acids are for instance preferred. Suitable heterocyclic atoms are for Instance N, O, S, B, P, Si, Al, and preferred heterocyclic atoms here are N, S, and/or O. In this regard, among others, —OH, a nitro group, an amino group, or an alkyl or alkoxy group can be named as a suitable substituent.

As at least bidentate organic compounds, the following are especially preferably used: acetylenedicarboxylic acid (ADC), benzenedicarboxylic acids, naphthalenedicarboxylic acids, biphenyldicarboxylic acids, such as 4,4'-biphenyldicarboxylic acid (BPDC), bipyridinedicarboxylic acids such as 2,2'-bipyridinedicarboxylic acids such as 2,2'-bipyridine-5,5'-dicarboxylic acid, benzenetricarboxylic acids such as 1,2,3-benzenetricarboxylic acid or 1,3,5-benzenetricarboxylic acid (BTC), adamantanetetracarboxylic acid (ATC), adamantanedibenzoate (ADB), benzenetribenzoate (BTB), methanetetrabenzoate (MTB), adamantanetetrabenzoate, or dihydroxyterephthalic acids, such as 2,5-dihydroxyterephthalic acid (DHBDC).

Quite particularly preferably, among others, isophthalic acid, terephthalic acid, 2,5-dihydroxyterephthalic acid, 1,2,3-benzenetricarboxylic acid, 1,3,5-benzenetricarboxylic acid, or 2,2'-bipyridine-5,5'-dicarboxylic acid are used.

Besides these at least bidentate organic compounds, the MOF can also include one or more monodentate ligands.

Suitable solvents for producing the MOF are among others ethanol, dimethyl formamide, toluene, methanol, chlorobenzene, diethyl formamide, dimethyl sulfoxide, water, hydrogen peroxide, methylamine, caustic soda solution, N-methylpolidone ether, acetonitrile, benzyl chloride, triethylamine, ethylene glycol, and mixtures thereof. Further metal ions, at least bidentate organic compounds, and solvents for the production of MOF are described in U.S. Pat. No. 5,648,508 or German Patent Disclosure DE-A 101 11 230, among other places.

The pore size of the MOF can be controlled by the choice of the suitable ligand and/or of the at least bidentate organic compound. It is generally true that the larger the organic compound is, the larger the pore size is. Preferably, the pore size is from 0.2 nm to 30 nm; especially preferably, the pore size is in the range from 0.3 nm to 3 nm, referred to the crystalline material.

In an MOF shaped body, however, larger bores also occur, whose size distribution can vary. Preferably, however, more than 50% of the total pore volume, and in particular more than 75%, is formed by pores with a pore diameter of up to 1000 nm. Preferably, however, a majority of the pore volume is formed of pores comprising two diameter ranges. It is therefore preferred if more than 25% of the total pore volume, and in particular more than 50% of the total pore volume, is formed by pores which are within a diameter range from 100 ma to 800 nm, and if more than 50% of the total pore volume, and in particular more than 25% of the total pore volume, is formed of pores that are within a diameter range of up to 10 nm. The pore distribution can be determined by means of mercury porosimetry.

The following remarks refer to the refueling operation during which a completely empty tank for holding a gaseous fuel is refilled with fuel at a filling station. In refueling, a system pressure, depending on the degree of filling of the tank holding the gaseous fuel, prevails that is on the order of magnitude of <100 bar, preferably <80 bar, and especially preferably ≦50 bar, but more than 10 bar.

Figure 2:
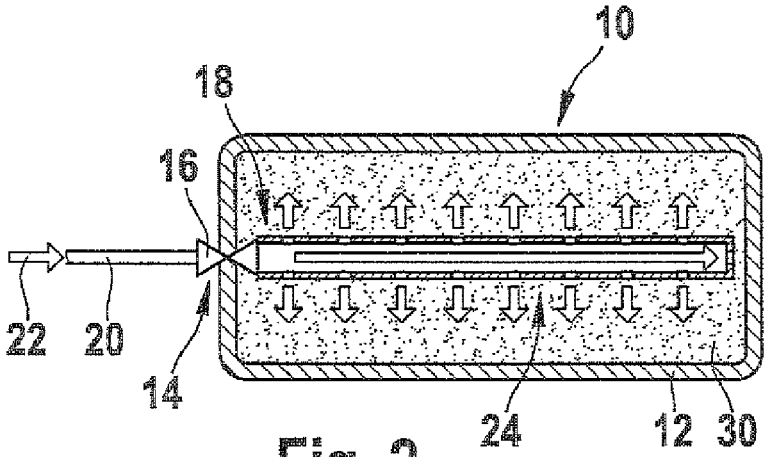
FIG. 2 shows a first variant embodiment of a tank inlet valve, including a check valve and a throttle valve with spatially distributed throttling.

From the illustration in FIG. 2, a first variant embodiment can be seen of the tank for gaseous fuel, with a tank inlet valve, including a check valve and a throttle valve that valve makes distributed throttling possible.

A tank 10 shown in FIG. 2 includes a wall 12 and is provided on a filling end with a tank inlet valve 14. The tank inlet valve 14 includes a check valve 16 as well as a throttle valve 18. The check valve 16 is designed such that it develops a slight throttling action, while the throttle valve 18 that belongs to the tank inlet valve 14 is designed such that it offers strong throttling action, compared to the throttling action of the check valve 16, or in other words, it represents at least a narrow opening cross section. The throttle valve 18, formed by a number of narrow opening cross sections that have fine structures, has all in all a large opening cross section, corresponding to the number of narrow opening cross sections.

The size of the tank inlet throttle restriction can be estimated as follows. The flow rate through a throttle restriction is in accordance with the equation below. This is a simplified throttling equation, in which the value of 0.7 is assumed for the geometry factor μ.

$$\dot{m} = \mu \cdot A \cdot p_1 \cdot \sqrt{\frac{2}{R_s \cdot T_1}} \cdot \psi$$

$$\psi = \begin{cases} \frac{1}{2} & \Pi \leq 0.5 \\ \sqrt{\Pi \cdot (1 - \Pi)} & \Pi > 0.5 \end{cases}$$

$$\text{in which } \Pi = \frac{p_2}{p_1}$$

The factor ψ can assume various values, depending on the pressure ratio. For supercritical pressure ratios ($p_1 > 2 * p_2$), it is constant, and the flow rate is not dependent on the pressure downstream of the throttle restriction. For subcritical pressure ratios ($p_1 < 2 * p_2$), $\psi = \sqrt{\Pi \cdot (1 - \Pi)}$.

In this formula, the following abbreviations are used:

$R_s$ specific gas constant $T_1$ temperature upstream of the throttle restriction A opening cross section of the throttle restriction mx flow rate μ geometry factor of the throttle restriction $p_2$ pressure downstream of the throttle restriction (vehicle tank)

$p_1$ pressure upstream of the throttle restriction (filling station)

The specific gas constant of methane is 519 J/kg/K (and is calculated by dividing the ideal gas constant by the molar mass). In this calculation example, methane is used to stand for natural gas, which primarily comprises methane.

By transposition of the outflow function downstream of throttle cross section A, the following is obtained:

$$A = \frac{\dot{m}}{\mu \cdot p_1 \cdot \sqrt{\frac{2}{R_s \cdot T_1}} \cdot \psi}$$

If a quantity of 30 kg of methane is to be received within 5 minutes (300 s), then a mean flow rate of 0.1 kg/s is necessary. Taking a constant pilot pressure at the filling station of $p_1$=300 bar as the point of departure and assuming a supercritical flow during the refueling, a valve cross section of A=2.65 $mm^2$ is the result. (Note on units: N=kg $m/s^2$ J=1 Nm Pa=1 $N/m^2$)

If the vehicle tank pressure rises over 150 bar, the supercritical flow changes to a subcritical flow. From that moment, the flow rate through the throttle restriction is then dependent on the counterpressure in the tank as well and decreases with increasing tank pressure. The requisite larger valve cross section for a subcritical flow is therefore calculated below with a constant pilot pressure $p_1$=300 bar and $p_2$=200 bar. That is, the pressure $p_2$ in the tank has already achieved the final value of 200 bar. At 300 bar pilot pressure, ψ assumes the value of 0.47.

$$A = \frac{\dot{m}}{\mu \cdot p_1 \cdot \sqrt{\frac{2}{R_s \cdot T_1}} \cdot \psi} = \frac{0.1\ \text{kg}}{s \cdot 0.7 \cdot 300 \cdot 10^5\ \text{Pa} \cdot \sqrt{\frac{2 \cdot \text{kg} \cdot K}{519\ \text{J} \cdot 298K}} \cdot 0.47} = 2.82\ \text{mm}^2$$

Thus the range in which the true valve cross section will be located is demarcated. Moreover, the capacity of the vehicle tank, the desired refueling time, and the pilot pressure at the filling station may deviate from the examples assumed here.

The throttle cross section calculated here is the total cross section that is required in the tank in order to be able to hold the desired amount of gas in the tank within the desired time. Depending on the thermal conductivity in the interior of the tank, it is advisable, for good local distribution of the effect of cooling from adiabatic expansion, to distribute this total cross section over many small cross sections.

A filling neck 20 extends at the tank inlet valve 14, oriented towards its check valve 16, and by way of this neck, gaseous fuel, such as $CH_4$ 22 , flows to the tank 10 as shown in FIG. 2. The symbol $p_1$ designates the pressure of the gaseous fuel 22, while $t_1$ identifies its temperature. The pressure $p_1$ and the temperature $t_1$ correspond to the status of the gaseous fuel 22, which is kept on hand in a filling station at a relatively high pressure and low temperature. The gas line between the nozzle at the tank line, of which only the individual neck 20, located immediately upstream of the tank 10, is shown here, is designed such that from the filling station to the inside of the tank 10, a pressure drop that is slight as possible ensues. It is only inside the tank 10 itself that the desired effect of throttling and the attendant further cooling of the gaseous fuel 22 takes place, in accordance with the invention.

As also seen from the illustration in FIG. 2, in the interior of the tank 10 is a throttle valve 18, embodied as a throttle pipe 24. In the variant embodiment of the tank 10 shown in FIG. 2, the throttle pipe 24 acting the throttle valve 18 extends centrally through the tank 10 and can be aligned with the filling neck 20. In addition to the throttle valve 18, designed as a throttle pipe 24 in the view in FIG. 2, there is also a sorption material 30 in the interior of the tank 10, and this sorption material forms an accumulation structure for the gaseous fuel 22, such as $CH_4$. As the sorption material 30, in accordance with the version proposed according to the invention, metal organic frameworks (MOFs) are preferably employed. As the tank is being filled, the gas accumulates at this accumulation structure, and the binding energy (desorption) is released in the form of heat and compensated for by the version proposed according to the invention. The status variables that the gaseous fuel inside the tank 10 assumes are designated as the pressure $p_2$ of the gaseous fuel, the temperature $t_2$ of the gaseous fuel 22, and a temperature $t_2'$, which is a heated temperature of the gaseous fuel 22 inside the tank 10.

While in the variant embodiment of FIG. 2 the throttle valve 18 is embodied as a throttle pipe 24, the throttle valve 18 can also be embodied as a perforated plate, in the form of fit, which can be made from glass or metal. Moreover, as throttle valves 18 at the tank inlet valve 14, both sintered metal and porous metal foams can be used.

Figure 3:
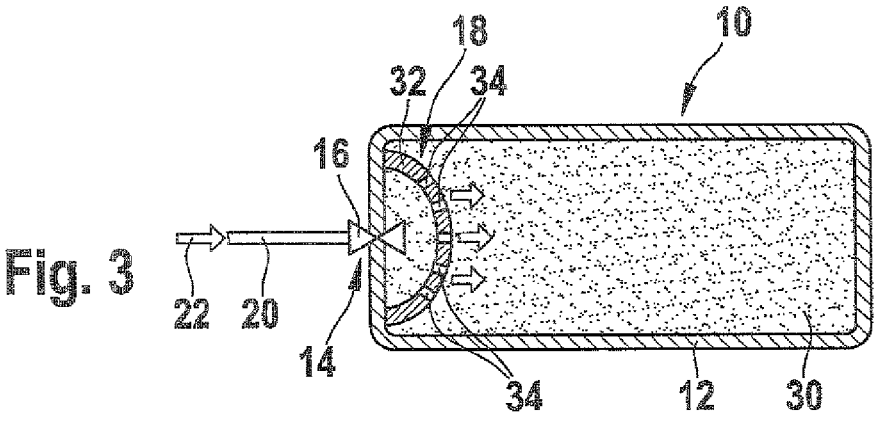
FIG. 3 shows a further variant embodiment of the tank inlet valve, including a check valve and a throttle valve of large throttle cross section.

From the view in FIG. 3, a further variant embodiment of the tank for gaseous fuel, having a tank inlet valve, a check valve and a throttle valve, as proposed according to the invention, can be seen.

It can be seen from the view in FIG. 3 that the tank inlet valve 14 is disposed on the filling end of the tank 10. The tank inlet valve 14 includes the check valve 16 as well as the throttle valve 18; the latter, in the variant embodiment of FIG. 3, can be embodied in hemispherical shape as a throttle restriction plate 32. A number of throttling conduits 34 are provided in the wall of the throttle restriction plate 32, and by way of them, after passage through the filling neck 20, with the check valve 16 open, the gaseous fuel 22 flows into the interior of the tank 10 under the influence of major throttling action. In the variant embodiment of FIG. 3, the sorption material 30 is located in the interior of the tank 10, and in accordance with the version proposed according to the invention, the sorption material is preferably embodied as MOF. Analogously to what is shown in FIG. 2, the state of the gaseous fuel 22, or in other words in the case of natural gas its primary component $CH_4$ for example, upon entering is designated by the pressure $p_1$ and the temperature $t_1$, while the state of the gaseous fuel 20 inside the tank 10 is indicated by the pressure $p_2$, the volume $V_2$, and the temperature $t_2$, and this temperature over the course of the refueling, because of the heat of desorption, changes to a higher temperature $t_2'$.

With respect to the variant embodiments shown in FIGS. 2 and 3, the variant embodiment shown in FIG. 2 is the preferred variant embodiment.

In the case of methane $CH_4$ as the gaseous fuel 22, this fuel cools down with adiabatic expansion. Methane has an isotropene exponent of $\kappa=1.3$, by which the attainable cooling effect is amplified still further. The work produced upon adiabatic expansion amounts to the following:

$$W_{mol} = \frac{R \cdot T}{\kappa - 1} \cdot \left[1 - \left(\frac{p_2}{p_1}\right)^{\frac{\kappa-1}{\kappa}}\right] \quad \text{Equation 1}$$

in which

W=work

R=gas constant

T=temperature $\kappa$=isentropene exponent $p_1$=pressure upstream of the throttle restriction $p_2$=pressure downstream of the throttle restriction In filling of the tank 10, the tank pressure $p_2$ rises from the initial pressure, with a tank that for example is completely empty, or an only partly empty tank, to the final pressure. The usable cooling energy K drops with decreasing tank pressure during the filling, as a function of the current tank pressure, as shown in the graph in FIG. 1. The cooling energy K is intended to compensate at least partly for the heat of adsorption A released, so that the temperature in the tank 10 remains as constant as possible. The temperature change inside the tank 10 is determined by the adsorbed gas quantity n, and the difference is $\Delta E = A - W$. This difference represents the net value of the quantities of heat employed. The temperature $\Delta T$ that ensues inside the tank is defined by the following equation:

$$\Delta T = \frac{n \cdot \Delta E}{C_{Sp} \cdot M_{Sp}} = \frac{n \cdot (A - W)}{C_{Sp} \cdot M_{Sp}} \quad \text{Equation 2}$$

n=fuel quantity of the refueled gas $C_{Sp}$=specific heat of the reservoir material $M_{Sp}$=mass of the reservoir $\Delta E$: energy difference A: Sorption enthalpy W: cooling work For estimating the cooling effect of methane $CH_4$, the following can be stated:

When a quantity of 30 kg of $CH_4$, corresponding to 1875 moles of $CH_4$, is put into the tank, a heat of adsorption A of 12.5 kJ/mol is produced. The work produced upon adiabatic expansion is W=kJ/mol, at a pressure $p_1$ of 200 bar and if the mass of the reservoir is approximately 200 kg. The specific heat $C_{Sp}$ of the reservoir material is approximately 1.3 kJ/kg/K. With these values, in accordance with equation 2, a temperature change $\Delta T$ of approximately 68.5° C. results. Without adiabatic cooling, or in other words without the work W produced upon adiabatic expansion, which work in this case would be 0, a temperature change $\Delta T$ of 90° C. would result, which corresponds to approximately 1.3 times the value with adiabatic cooling.

Figure 4:
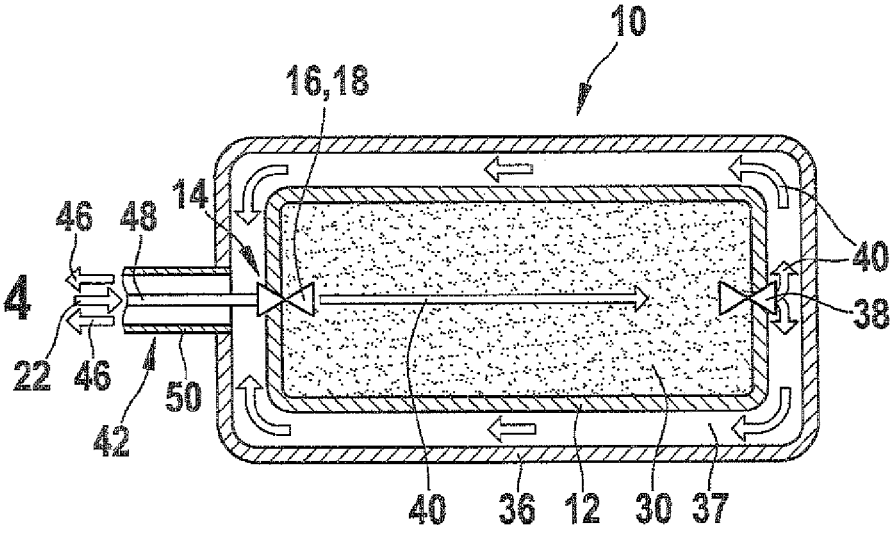
FIG. 4 shows a variant embodiment of a double-walled tank with gas return in the double wall.

From the illustration in FIG. 4, a variant embodiment of the tank proposed according to the invention can be seen, with a tank inlet valve that includes a check valve and a throttle valve, and with a double wall.

from the illustration in FIG. 4, it can be seen that the tank 10 is surrounded by a double wall 36. The double wall 36 together with the wall 12 located on the inside in the variant embodiment of FIG. 4 forms a hollow chamber 37. The sorption material 34, which is preferably an MOF, is located inside the wall 12 of the tank 10. The gaseous fuel 22 flows to the interior of the tank 10, via a double-walled stub 42. The double-walled stub 42 includes an inner neck 48 and an outer neck 50 surrounding the inner neck. The inner neck 48 serves the purpose of the inflow of the gaseous fuel 22 in the flow direction 40. The gaseous fuel 22 first flows through the interior of the tank 10 and cools it down to such an extent that the heating from sorption is adequately compensated for. The gaseous fuel 22 flows out at an overflow valve 38 and through the hollow chamber 37, defined by the wall 12 and the double wall 36, back to the tank via the outer neck 50, surrounding the inner neck 48, of the double-walled stub 42. In this variant embodiment, the gas flows through the tank 10 and the hollow chamber 37 before being extracted by suction at the filling station. As a result, the effort required for cooling with regard to cooling of the tank 10 in the vehicle can be dispensed with, and a possible remaining cooling effort can be shifted from the vehicle to the filling station. In the version proposed according to the invention, the cooling of the tank 10 is effected by the combination of the physical effect of adiabatic expansion, which at least partially if not completely compensates for the physical effect of heating of the tank 10 from sorption, such as physical adsorption when MOF is used.

Figure 5:
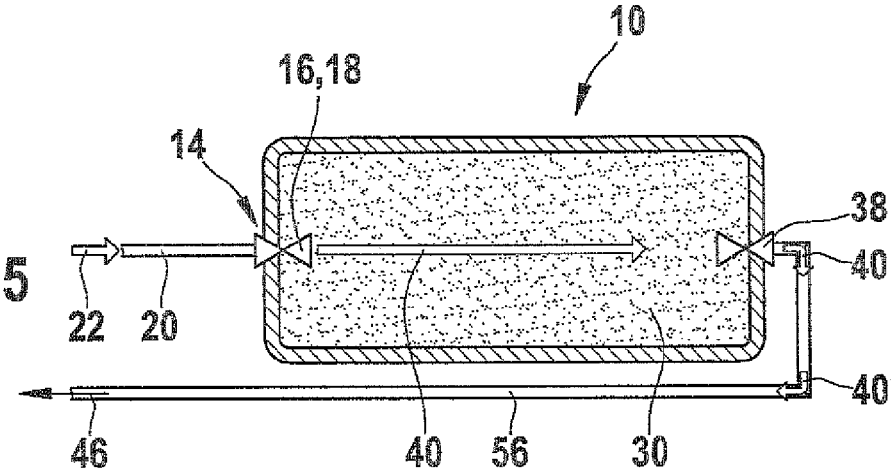
FIG. 5 shows a variant embodiment of the tank with a separate gas return line, connected to an overflow valve.

From the variant embodiment shown in FIG. 5, a tank for gaseous fuel can be seen, with a tank inlet valve that includes a check valve and a throttle valve, with a separate return line.

From FIG. 5 it can be seen that on the inlet side of the tank 10, which is embodied here with a wall 12, the filling neck 20 discharges into the tank inlet valve 14. After flowing through the check valve 16, the gaseous fuel 22 flows via the throttle valve 18 into the interior of the tank 10, where the sorption material 30 is located. The sorption material 30 is preferably metal organic frameworks (MOFs).

The gaseous fuel 22 flows in the flow direction 40 into the interior of the tank 10 and leaves the tank through an overflow valve 38, to which a return line 56 is connected. The overflow valve 38 likewise develops a throttling action, as a result of which the part of the wall 28 that is diametrically opposite the overflow valve 38 can be additionally cooled. This is equally true for the variant embodiments shown in both FIG. 4 and FIG. 5. In accordance with the gas flow direction 40, the gas emerging from the interior of the tank 10 flows back to the filling station during the refueling operation, in the form of returning gaseous fuel 46. In this variant embodiment as well, the gas first flows through the tank 10 and cools it down, by the effects explained above, before the portion of the gaseous fuel 22 that has not accumulated at the sorption material 30 leaves the interior of the tank 10 again in the gas flow direction, via the separate return line 56. In the variant embodiments of the tank 10 for gaseous fuels shown in FIG. 4 and FIG. 5, the tank Inlet valves 14, shown in conjunction with FIGS. 2 and 3, can be used, which contain-both a check valve 16 and a throttle valve 18, whether the latter is a throttle pipe 24, or a throttle restriction plate 32 with throttling conduits.

When the variant embodiments of FIGS. 4 and 5 are compared, the variant embodiment shown in FIG. 4 represents the preferred embodiment.

The foregoing relates to the preferred exemplary embodiment of the invention, it being understood that other variants and embodiments thereof are possible within the spirit and scope of the invention, the latter being defined by the appended claims.

The invention claimed is:

1. A sorption reservoir for gaseous fuel in a vehicle, said sorption reservoir comprising:

at least one wall defining the sorption reservoir, and in whose interior a sorption material is received; and a tank inlet valve which has a check valve and a throttle valve having a large throttle cross section, wherein throttling of the gaseous fuel is effected inside the sorption reservoir, wherein the throttling of the gaseous fuel inside the sorption reservoir is effected at a plurality of throttle restrictions disposed within the throttle valve, and wherein the throttle restrictions are embodied on a circumference of a throttle pipe acting as a throttle valve, which throttle pipe extends through or partway through the sorption reservoir.

2. A sorption reservoir for gaseous fuel in a vehicle, said sorption reservoir comprising:

at least one wall defining the sorption reservoir, and in whose interior a sorption material is received; and a tank inlet valve which has a check valve and a throttle valve having a large throttle cross section, wherein throttling of the gaseous fuel is effected inside the sorption reservoir, wherein the throttle valve is embodied as a spherical or curved throttle restriction plate with one or more throttling conduits disposed in the throttle restriction plate.

3. The sorption reservoir as defined by claim 2, wherein the throttle valve is formed by a sintered material or porous metal foam.

4. A sorption reservoir for gaseous fuel in a vehicle, said sorption reservoir comprising:

a first wall defining the sorption reservoir, and in whose interior a sorption material is received; and a second wall surrounding said first wall thereby forming a hollow chamber between the first wall and the second wall that discharges returning gaseous fuel in a double-walled stub connected to the sorption reservoir on an inlet valve side thereof, and a tank inlet valve which has a check valve and a throttle valve having a large throttle cross section, wherein throttling of the gaseous fuel is effected inside the sorption reservoir.

5. The sorption reservoir as defined by claim 4, wherein gaseous fuel flows into the sorption reservoir via an inner stub of the double-walled stub, and the returning gaseous fuel flows back to a supply source via an outer stub of the double-walled stub.

6. The sorption reservoir as defined by claim 4, wherein the sorption reservoir contains an overflow valve with throttling action, which discharges gaseous fuel into the hollow chamber or to a return line for excess gaseous fuel connected thereto.

7. The sorption reservoir as defined by claim 6, wherein the overflow valve with throttling action is disposed at a maximum distance from the tank inlet valve, to lengthen a course of through-flow of the gaseous fuel through the sorption reservoir, and for combining a heat of sorption inside the sorption reservoir.

8. The sorption reservoir as defined by claim 6, wherein the return line is embodied extending around an exterior of the outer wall.

* * * * *